US006255624B1

(12) United States Patent
Boaz et al.

(10) Patent No.: US 6,255,624 B1
(45) Date of Patent: Jul. 3, 2001

(54) ELECTRICALLY HEATED BACKLITE ASSEMBLY AND METHOD

(75) Inventors: Premakaran Tucker Boaz, Livonia; Paul Joseph Kolokowski, Southgate, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/470,001

(22) Filed: Dec. 22, 1999

(51) Int. Cl.[7] ..... H05B 1/00

(52) U.S. Cl. ..... 219/219; 219/203; 219/522; 338/308

(58) Field of Search ..... 219/203, 219, 219/522, 541, 543, 547; 338/307, 308, 309, 314

(56) References Cited

U.S. PATENT DOCUMENTS

| | | | | |
|---|---|---|---|---|
| 3,067,310 | | 12/1962 | Walz et al. . | |
| 3,612,745 | | 10/1971 | Warren . | |
| 3,765,994 | | 10/1973 | Quaintance et al. . | |
| 3,790,752 | * | 2/1974 | Boaz et al. | 219/522 |
| 3,833,451 | * | 9/1974 | Wagner | 219/522 |
| 3,903,396 | * | 9/1975 | Boaz et al. | 219/547 |
| 3,999,040 | | 12/1976 | Ellis . | |
| 4,137,447 | * | 1/1979 | Boaz | 219/522 |
| 4,246,467 | * | 1/1981 | Boaz | 219/522 |
| 4,352,006 | | 9/1982 | Zega . | |
| 4,373,130 | | 2/1983 | Krasborn et al. . | |
| 4,385,226 | | 5/1983 | Sauer . | |
| 4,388,522 | | 6/1983 | Boaz . | |
| 4,429,216 | | 1/1984 | Brigham . | |
| 4,443,691 | * | 4/1984 | Sauer | 219/522 |
| 4,450,346 | * | 5/1984 | Boaz | 219/522 |
| 4,634,242 | | 1/1987 | Taguchi et al. . | |
| 4,721,845 | * | 1/1988 | Kunert et al. | 219/203 |
| 4,910,380 | | 3/1990 | Reiss et al. . | |
| 5,332,888 | * | 7/1994 | Tausch et al. | 219/547 |
| 5,344,591 | | 9/1994 | Smuckler . | |
| 5,388,509 | | 2/1995 | Cutcher . | |
| 5,390,595 | | 2/1995 | Cutcher . | |
| 5,421,256 | | 6/1995 | Cutcher . | |
| 5,796,071 | * | 8/1998 | Morin et al. | 219/203 |
| 6,011,244 | * | 1/2000 | Castle | 219/522 |

* cited by examiner

*Primary Examiner*—Teresa Walberg
*Assistant Examiner*—Fadi H. Dahbour
(74) *Attorney, Agent, or Firm*—Larry I. Shelton

(57) ABSTRACT

An electrically heated backlite assembly and method of making same includes a glass panel and an opaque, electrically nonconductive coating bonded to the glass panel. The electrically nonconductive coating has an outer surface with a plurality of first undulations at selected locations. The electrically heated backlite assembly also includes an electrically conductive coating overlying and bonded to the electrically nonconductive coating. The electrically conductive coating has a generally smooth outer surface and an inner surface with a plurality of second undulations complementary to the first undulations at the selected locations. The electrically heated backlite assembly includes a conductor strip attached to the electrically conductive coating at the selected locations and for connection to a source of power to provide power to the electrically conductive coating to heat the glass panel to de-ice and defog the glass panel.

19 Claims, 1 Drawing Sheet

ELECTRICALLY HEATED BACKLITE ASSEMBLY AND METHOD

BACKGROUND OF THE INVENTION

1. Field of the Invention

The present invention relates generally to vehicles and, more specifically, to an electrically heated backlite assembly and method of making the same for a vehicle.

2. Description of the Related Art

It is known to provide a glass panel for an opening on a vehicle. It is also known to provide an electrically heated backlite on the glass panel to defog or de-ice the same, thereby providing a clear window in the vehicle. An example of such an electrically heated backlite is disclosed in U.S. Pat. No. 4,388,522 to Boaz. In this patent, the electrically heated backlite includes an opaque, electrically nonconductive coating bonded to a glass panel and an electrical resistance heater overlying and bonded to the electrically nonconductive coating. The electrically heated backlite also includes an electrical conductor bonded to a terminal end of the heater.

To manufacture the electrically heated backlite, the opaque, electrically non-conductive coating is black in the form of an ink or paint, which is screen printed onto the glass panel. The electrical resistance heater line is silver in the form of an ink or paint, which is screen printed onto the electrically non-conductive coating and the glass panel.

Although these electrically heated backlites have worked well, it is desirable to deposit a heavier layer of silver to help in the terminal soldering process at selected locations. It is also desirable to provide an electrically heated backlite that does not require modification of the screen that prints the silver on the glass panel. Therefore, there is a need in the art to provide an electrically heated backlite assembly and method that meets these desires.

SUMMARY OF THE INVENTION

Accordingly, the present invention is an electrically heated backlite assembly including a glass panel and an opaque, electrically nonconductive coating bonded to the glass panel. The electrically nonconductive coating has an outer surface with a plurality of first undulations at selected locations. The electrically heated backlite assembly also includes an electrically conductive coating overlying and bonded to the electrically nonconductive coating. The electrically conductive coating has a generally smooth outer surface and an inner surface with a plurality of second undulations complementary to the first undulations at the selected locations. The electrically heated backlite assembly includes a conductor strip attached to the electrically conductive coating at the selected locations and for connection to a source of power to provide power to the electrically conductive coating to heat the glass panel to deice and defog the glass panel.

The present invention is also a method of making an electrically heated backlite assembly. The method includes the steps of providing a glass panel, depositing an electrically nonconductive coating on the glass panel and forming an outer surface with a plurality of first undulations at selected locations. The method also includes the steps of depositing an electrically conductive coating on the electrically nonconductive coating and the glass panel and forming an inner surface with second undulations at the selected areas complementary to the first undulations of the electrically nonconductive coating and an outer surface being generally smooth. The method further includes the steps of attaching a conductor strip to the electrically conductive coating at the selected locations to provide power to the electrically conductive coating to heat the glass panel to de-ice and defog the glass panel.

One advantage of the present invention is that a new electrically heated backlite assembly is provided for a vehicle. Another advantage of the present invention is that a method of making the electrically heated backlite assembly is provided to vary the amount of silver deposited in the screen printing process. Yet another advantage of the present invention is that the electrically heated backlite assembly has a heavier or thicker layer of silver deposited at selected locations to help in the terminal soldering process. Still another advantage of the present invention is that the electrically heated backlite assembly has a surface contour on the glass panel controlled to vary the amount of silver deposit. A further advantage of the present invention is that the electrically heated backlite assembly does not require modification of the construction of the screen that prints the silver.

Other features and advantages of the present invention will be readily appreciated as the same becomes better understood after reading the subsequent description when taken in conjunction with the accompanying drawings.

DESCRIPTION OF THE PREFERRED EMBODIMENT(S)

Figure 1:
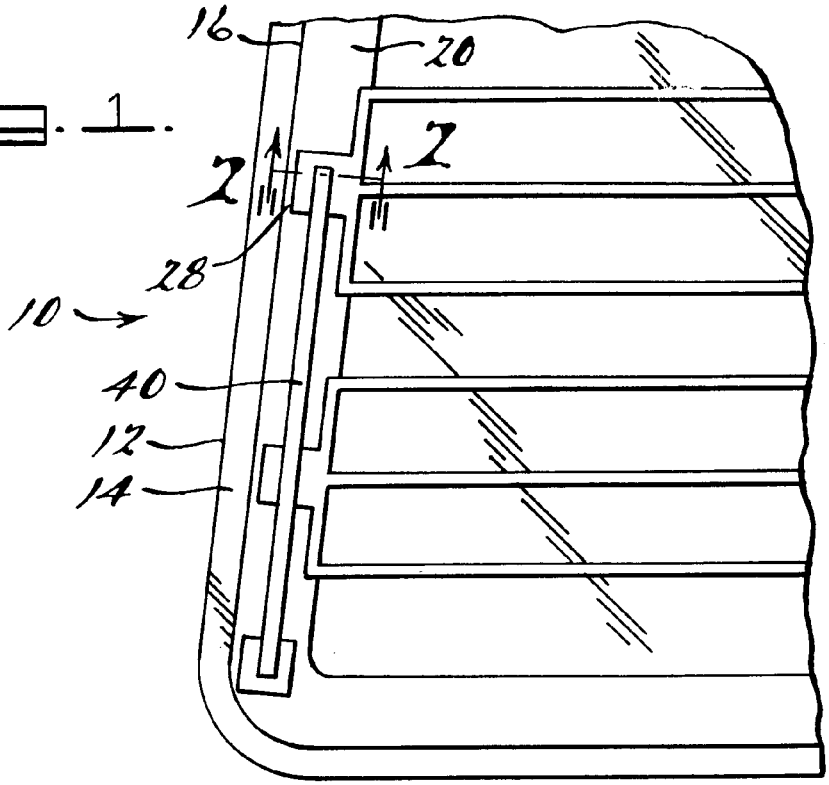
FIG. 1 is a partial elevational view of an electrically heated backlite assembly, according to the present invention.
Figure 2:
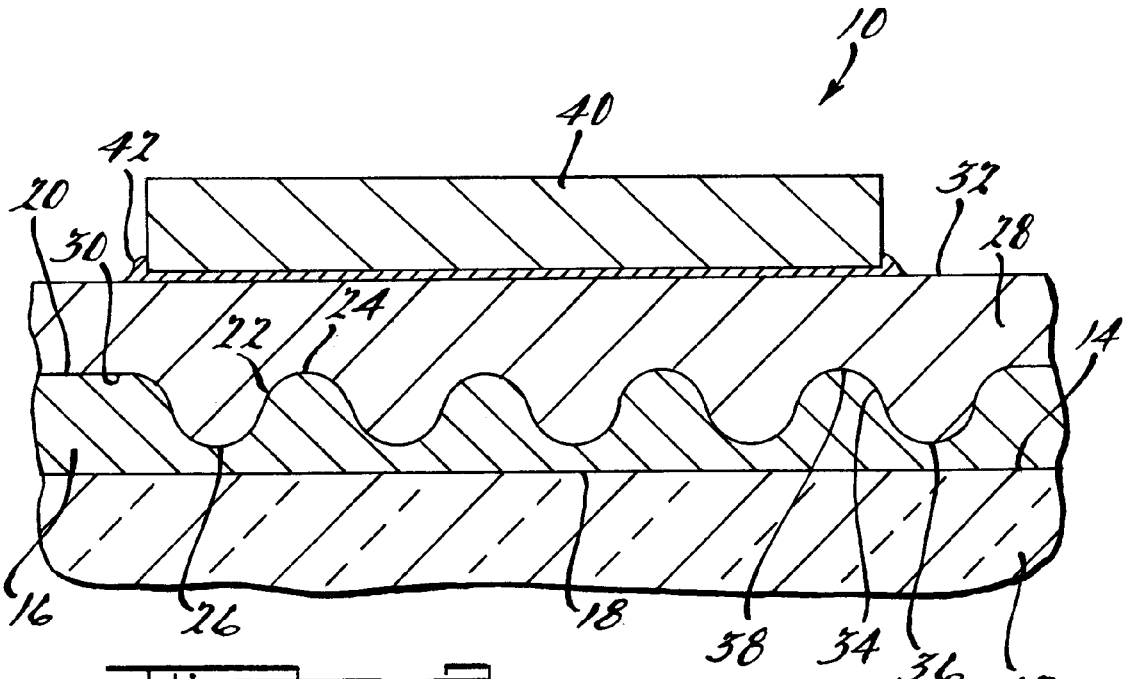
FIG. 2 is a sectional view taken along line 2—2 of FIG. 1.

Referring now to the drawings and in particular FIGS. 1 and 2, one embodiment of an electrically heated backlite assembly 10, according to the present invention, is shown for a vehicle (not shown). The electrically heated backlite assembly 10 is mounted to vehicle structure surrounding an opening 14 of the motor vehicle. The electrically heated backlite assembly 10 can be employed at a number of places on the vehicle, including the front or rear doors or front or rear of the vehicle. To that end, the specific electrically heated backlite assembly 10 shown in FIG. 1 and FIG. 2 is for purposes of illustration and not by way of limitation.

The electrically heated backlite assembly 10 includes a glass sheet or panel 12. The glass panel 12 is generally planar and rectangular in shape. The glass panel 12 in made of a transparent material such as glass, plastic or the like. The glass panel 12 may have any suitable thickness such as five millimeters. The glass panel 12 has a surface 14 to face the interior of the vehicle. The surface 14 is generally smooth. It should be appreciated that the glass panel 12 is conventional and known in the art.

The electrically heated backlite assembly 10 also includes an opaque, electrically nonconductive coating 16 bonded to the glass panel 12. As illustrated in FIG. 1, the electrically nonconductive coating 16 extends around the entire perimeter of the glass panel 12. The electrically nonconductive coating 16 has an inner surface 18 which abuts and is bonded to the surface 14 of the glass panel 12. The inner surface 18 is generally smooth. The electrically nonconductive coating 16 also has an outer surface 20 spaced from the inner surface 18. The outer surface 20 is generally smooth. The electrically nonconductive coating 16 has a predetermined width such as desired by styling requirements. The electrically nonconductive coating 16 has a predetermined thickness such 0.0008 inches to 0.0015 inches. The outer surface 20 includes a plurality of undulations or contours 22 at selected or predetermined locations such as terminal areas for a function to be described. Each undulation 22 has a peak 24 and valley 26. The peaks 24 have a thickness approximately equal to the predetermined thickness of the electrically nonconductive coating 16. The valleys 26 have a thickness of approximately 0.0005 inches from the inner surface 18. The electrically nonconductive coating 16 provides a sight shield for lending more uniform characteristics to the appearance of the glass panel 12 when viewed from the outside of the vehicle. The electrically nonconductive coating 16 is used to block out the color developed by a layer of silver material to be described which is used to form the terminal areas and grid lines to be described. Preferably, the electrically nonconductive coating 16 is a black or neutral in color, however, the color can be selected to give a better color coordination with the exterior color of the vehicle in which the electrically heated backlite assembly 10 is installed. The electrically nonconductive coating 16 is made of a black ceramic material. The electrically nonconductive coating 16 is in the form of an ink or paint that is screen printed to the glass panel 12 by conventional screen printing processes. It should be appreciated that the material for the electrically nonconductive coating 16 is conventional and known in the art.

The electrically heated backlite assembly 10 further includes an electrically conductive coating 28 overlying and bonded to the electrically nonconductive coating 16 and glass panel 12. As illustrated in FIG. 1, the electrically conductive coating 28 forms terminal areas on the electrically nonconductive coating 16 and thin grid lines on the glass panel 12 extending laterally across the glass panel 12. The electrically conductive coating 28 has an inner surface 30 which abuts the outer surface 20 of the electrically nonconductive coating 16 and the outer surface 14 of the glass panel 12. The inner surface 30 is generally smooth at non-selected locations. The electrically conductive coating 28 also includes an outer surface 32 spaced from the inner surface 30. The outer surface 32 is generally smooth.

The electrically conductive coating 28 has a predetermined width such as is required to carry the electrical current load, preferably 0.25 inches to 1.5 inches. The electrically conductive coating 28 has a predetermined thickness such 0.0005 inches to 0.001 inches. The inner surface 30 includes a plurality of undulations or contours 34 complementary to the undulations 22 of the electrically nonconductive coating 16 at the terminal areas. Each undulation 34 has a peak 36 and valley 38. The peaks 36 have a thickness greater than the predetermined thickness of the electrically conductive coating 28 such as 0.0015 inches to form a heavier or thicker deposit. The valleys 38 have a thickness approximately equal to the predetermined thickness of the electrically conductive coating 28. Preferably, the electrically conductive coating 28 is a silver ceramic material. The electrically conductive coating 28 is in the form of an ink or paint that is screen printed onto the electrically nonconductive coating 16 and the glass panel 12 by conventional screen printing processes. It should be appreciated that the material for the electrically conductive coating 28 is conventional and known in the art. It should also be appreciated that the electrically conductive coating 28 does not have undulations in the grid lines.

The electrically heated backlite assembly 10 includes a conductor or terminal strip 40 attached by solder 42 to the outer surface 32 of the electrically conductive coating 28 at the terminal areas thereof. The conductor strip 40 extends longitudinally and is generally rectangular in shape. The conductor strip 40 is connected to a power source (not shown) such as controller. It should be appreciated that the controller provides the power to the conductor strip 40 and, in turn, to the electrically conductive coating 28, which provides heat to the glass panel 12 in order to de-ice or defog the same. It should be appreciated that the conductor strip 40 is conventional and known in the art.

A method, according to the present invention, is disclosed of making the electrically heated backlite assembly 10. The method includes the step of providing the glass panel 12. The method includes the step of depositing the electrically nonconductive coating 16 by providing a screen and printing the electrically nonconductive coating 16 onto the glass panel 12. The printing of the electrically nonconductive coating 16 is accomplished by conventional screen-printing and includes forming the outer surface 20 with the undulations 22 at selected locations, preferably at the terminal areas. The method includes the step of depositing the electrically conductive coating 28 by providing a screen and printing the electrically conductive coating 28 on the electrically nonconductive coating 16 and the glass panel 12. The printing of the electrically conductive coating 28 is accomplished by conventional screen printing and includes forming the inner surface 30 with undulations 34 at the selected areas, preferably the terminal areas, complementary to the undulations 22 in the electrically nonconductive coating 16 and forming the outer surface 32 generally smooth. The method includes the step of disposing the conductor strip 40 against the electrically conductive coating 28 at the terminal areas and attaching the conductor strip 40 to the electrically conductive coating 28 by a solder layer 42 to form the electrically heated backlite assembly 10. The step of attaching is accomplished by conventional soldering processes. The electrically heated backlite assembly 10 is then shipped to an assembly plant for installation or assembly to the vehicle by conventional methods known in the art.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electrically heated backlite assembly comprising:

a glass panel;

an opaque, electrically nonconductive coating bonded to said glass panel, said electrically nonconductive coating having an outer surface with a plurality of first undulations at selected locations;

an electrically conductive coating overlying and bonded to said electrically nonconductive coating, said electrically conductive coating having a generally smooth outer surface and an inner surface with a plurality of second undulations complementary to said first undulations at the selected locations, wherein said electrically conductive coating at the selected locations has a thickness greater than a thickness at non-selected locations; and a conductor strip attached to said electrically conductive coating at the selected locations and for connection to a source of power to provide power to said electrically conductive coating to heat said glass panel to de-ice and defog said glass panel.

2. An electrically heated backlite assembly as set forth in claim 1 wherein said electrically conductive coating is a silver ceramic material.

3. An electrically heated backlite assembly as set forth in claim 1 wherein said electrically nonconductive coating is a black ceramic material.

4. An electrically heated backlite assembly as set forth in claim 1 wherein said glass panel has a surface being generally smooth.

5. An electrically heated backlite assembly as set forth in claim 1 wherein said outer surface of said electrically conductive coating is generally smooth at nonselected locations.

6. An electrically heated backlite assembly as set forth in claim 1 wherein said first undulations and said second undulations comprise a plurality of peaks and valleys.

7. An electrically heated backlite assembly as set forth in claim 1 including solder to attach said conductor strip to said electrically conductive coating at the selected locations.

8. An electrically heated backlite assembly comprising:

a glass panel;

an opaque, electrically nonconductive coating bonded to said glass panel, said electrically nonconductive coating having an outer surface with a plurality of first undulations at selected locations;

an electrically conductive coating overlying and bonded to said electrically nonconductive coating, said electrically conductive coating having a generally smooth outer surface and an inner surface with a plurality of second undulations complementary to said first undulations at the selected locations;

a conductor strip attached to said electrically conductive coating at the selected locations and for connection to a source of power to provide power to said electrically conductive coating to heat said glass panel to de-ice and defog said glass panel;

wherein said glass panel has a surface being generally smooth; and wherein said electrically nonconductive coating has an inner surface abutting said surface of said glass panel, said inner surface being generally smooth at nonselected locations.

9. An electrically heated backlite assembly comprising:

a glass panel;

an opaque, electrically nonconductive coating bonded to said glass panel, said electrically nonconductive coating having an outer surface with a plurality of first undulations at selected locations;

an electrically conductive coating overlying and bonded to said electrically nonconductive coating, said electrically conductive coating having a generally smooth outer surface and an inner surface with a plurality of second undulations complementary to said first undulations at the selected locations;

a conductor strip attached to said electrically conductive coating at the selected locations and for connection to a source of power to provide power to said electrically conductive coating to heat said glass panel to de-ice and defog said glass panel;

wherein said first undulations and said second undulations comprise a plurality of peaks and valleys; and wherein said peaks of said electrically conductive coating have a thickness of approximately 0.0015 inches from said outer surface.

10. An electrically heated backlite assembly comprising:

a glass panel;

an opaque, electrically nonconductive coating bonded to said glass panel, said electrically nonconductive coating having an outer surface with a plurality of first undulations at selected locations;

an electrically conductive coating overlying and bonded to said electrically nonconductive coating, said electrically conductive coating having a generally smooth outer surface and an inner surface with a plurality of second undulations complementary to said first undulations at the selected locations;

a conductor strip attached to said electrically conductive coating at the selected locations and for connection to a source of power to provide power to said electrically conductive coating to heat said glass panel to de-ice and defog said glass panel;

wherein said first undulations and said second undulations comprise a plurality of peaks and valleys; and wherein said valleys of said electrically nonconductive coating have a thickness of approximately 0.0005 inches from said glass panel.

11. An electrically heated backlite assembly for a vehicle comprising:

a glass panel;

an opaque, electrically nonconductive black ceramic coating bonded to said glass panel, said black ceramic coating having an outer surface with a plurality of first undulations at selected locations;

an electrically conductive silver ceramic coating overlying and bonded to said black ceramic coating, said silver ceramic coating having a generally smooth outer surface and an inner surface with a plurality of second undulations complementary to said first undulations at the selected locations, wherein said electrically conductive coating at the selected locations has a thickness greater than a thickness at non-selected locations; and a conductor strip attached to said silver ceramic coating at the selected locations and for connection to a source of power to provide power to said silver ceramic coating to heat said glass panel to de-ice and defog said glass panel.

12. An electrically heated backlite assembly as set forth in claim 11 wherein said outer surface of said silver ceramic coating is generally smooth at nonselected locations.

13. An electrically heated backlite assembly as set forth in claim 12 wherein said black ceramic coating has an inner surface abutting said glass panel, said inner surface being generally smooth at nonselected locations.

14. An electrically heated backlite assembly as set forth in claim 11 wherein said first undulations and said second undulations comprise a plurality of peaks and valleys.

15. An electrically heated backlite assembly for a vehicle comprising:

a class panel;

an opaque, electrically nonconductive black ceramic coating bonded to said glass panel, said black ceramic coating having an outer surface with a plurality of first undulations at selected locations;

an electrically conductive silver ceramic coating overlying and bonded to said black ceramic coating, said silver ceramic coating having a generally smooth outer surface and an inner surface with a plurality of second undulations complementary to said first undulations at the selected locations;

a conductor strip attached to said silver ceramic coating at the selected locations and for connection to a source of power to provide power to said silver ceramic coating to heat said glass panel to de-ice and defog said glass panel;

wherein said first undulations and said second undulations comprise a plurality of peaks and valleys; and wherein said peaks of said silver ceramic coating have a thickness of approximately 0.0015 inches from said outer surface.

16. An electrically heated backlite assembly for a vehicle comprising:

a glass panel;

an opaque, electrically nonconductive black ceramic coating bonded to said glass panel, said black ceramic coating having an outer surface with a plurality of first undulations at selected locations;

an electrically conductive silver ceramic coating overlying and bonded to said black ceramic coating, said silver ceramic coating having a generally smooth outer surface and an inner surface with a plurality of second undulations complementary to said first undulations at the selected locations;

a conductor strip attached to said silver ceramic coating at the selected locations and for connection to a source of power to provide power to said silver ceramic coating to heat said glass panel to de-ice and defog said glass panel;

wherein said first undulations and said second undulations comprise a plurality of peaks and valleys; and wherein said valleys of said black ceramic coating have a thickness of approximately 0.0005 inches from said glass panel.

17. A method of making an electrically heated backlite assembly comprising the steps of:

providing a glass panel;

depositing an electrically nonconductive coating on the glass panel and forming an outer surface with a plurality of first undulations at selected locations;

depositing an electrically conductive coating on the electrically nonconductive coating and the glass panel and forming an inner surface with second undulations at the selected locations complementary to the first undulations of the electrically nonconductive coating and an outer surface being generally smooth and depositing the electrically conductive coating at the selected locations in a thickness greater than nonselected locations; and attaching a conductor strip to the electrically conductive coating at the selected locations to provide power to the electrically conductive coating to heat the glass panel to de-ice and defog the glass panel.

18. A method as set forth in claim 17 wherein said step of depositing the electrically nonconductive coating comprises providing a screen and screen printing the electrically nonconductive coating on the glass panel.

19. A method as set forth in claim 17 wherein said step of depositing the electrically conductive coating comprises providing a screen and screen printing the electrically conductive coating over the electrically nonconductive coating and the glass panel.

* * * * *